United States Patent [19]

Johnson et al.

[11] 4,300,379

[45] Nov. 17, 1981

[54] METHOD OF PRODUCING A COATING ON A CORE

[75] Inventors: Morris E. Johnson, Batavia, Ill.; William G. Voorhes, East Greenwich; Dennis L. Breneiser, Jamestown, both of R.I.

[73] Assignee: Nichols-Homeshield, Inc., Aurora, Ill.

[21] Appl. No.: 177,353

[22] Filed: Aug. 11, 1980

Related U.S. Application Data

[63] Continuation of Ser. No. 923,204, Jul. 10, 1978, abandoned, which is a continuation-in-part of Ser. No. 709,331, Jul. 28, 1976, abandoned, which is a continuation of Ser. No. 590,849, Jun. 27, 1975, abandoned.

[51] Int. Cl.[3] ..... B21C 23/22

[52] U.S. Cl. ..... 72/258; 427/11; 72/262

[58] Field of Search ..... 164/86, 98, 99; 72/258, 72/259, 262; 118/77, 78; 427/11

[56] References Cited

U.S. PATENT DOCUMENTS

| | | | |
|---|---|---|---|
| 3,040,884 | 6/1962 | Haendeler | 72/259 |
| 3,399,557 | 9/1968 | Lang et al. | 72/258 |
| 3,545,246 | 1/1970 | Riemann | 72/258 |
| 3,620,119 | 11/1971 | King, Jr. et al. | 72/258 |
| 3,922,898 | 12/1975 | Voorhes | 72/43 |

*Primary Examiner*—R. L. Spruill
*Assistant Examiner*—K. Y. Lin
*Attorney, Agent, or Firm*—McWilliams, Mann & Zummer

[57] ABSTRACT

A method of providing a member having a metal core with a nonferrous coating wherein the metal core affords strength and rigidity while the nonferrous outer coating, or cladding, provides a non-corrodible surface and wherein the cladding is of such uniform thickness that final forming of the member may be performed without penetrating or breaking the coating, or exposing the core. The cladding is applied by extruding the nonferrous material in a cross-axis die where it reaches a plastic state and passing the metal core through the plastic non-ferrous metal in the die with the high extrusion pressure creating heat to render the nonferrous metal in a plastic state and further extruding the nonferrous metal around the metal core as it exits from the die, whereby to obtain a wrought structure of the clad coating, without reducing the cross-sectional area of the core during the extrusion operations.

14 Claims, 7 Drawing Figures

METHOD OF PRODUCING A COATING ON A CORE

This application is a continuation of copending application Ser. No. 923,204, filed July 10, 1978, now abandoned as a continuation-in-part of applications Ser. No. 709,331, filed July 28, 1976, now abandoned, which was a continuation of application Ser. No. 590,849, filed June 27, 1975, now abandoned.

BACKGROUND OF THE INVENTION

It is quite common in the field where various types of fasteners are utilized in the assembly of materials, that environmental conditions frequently result in rust or corrosion occurring on the fasteners, or between the fasteners and the assembled materials. Many times this may be due in large part to the electrical current that occurs between different materials and especially where the work pieces held together by the fasteners may all be of different materials having different electrical potentials. The rate of decomposition and/or corrosion of the work pieces and the fasteners may also be affected by the nature of the connection of the fasteners and work pieces as a result of the stress level imposed on the connections which may increase the degree of corrosion. External forces applied to the work pieces, or an improper, or interference fit of the fasteners in the work pieces may also affect the corrosion factor.

Heretofore, electroplated metals utilizing cadmium or zinc or any of various organic coatings have been utilized to inhibit corrosion and electrolytic action. However, thin coatings of these materials were relied upon and such coatings were easily ruptured and thus exposed the core metals to the environment. In such circumstances aluminum or plastic coatings would have been more satisfactory since these materials would not readily permit corrosion to occur between the fasteners and work pieces. While such materials may have been superior in many respects to cadmium, zinc and other electroplated materials they did not lend themselves readily to electrodeposition on the fasteners. Further, and more importantly, the degree of corrosion protection afforded by any coating on a fastener of any kind is directly proportional to the thickness and uniformity of the applied coating and since electrodeposition of coating metal is typically limited to thin coatings, fasteners clad in this manner have been lacking in effective coating thickness and totally inadequate from the standpoint of corrosion resistance. In fact, such coatings, or cladding, were quickly destroyed and allowed corrosive reactions to develop between the fasteners and the work pieces.

Other problems incurred by electroplating coatings on fasteners include embrittlement of the coating, as thus applied. Hot dipping of fasteners with zinc or aluminum may provide a coating of adequate thickness, but coatings applied in this manner are frequently lacking in the uniform thickness of the coating necessary to provide the degree of corrosion protection for fasteners thus coated as normally required in the usual operating environment.

Mechanical coating by peen plating has been used to some extent but this type of coating process is restricted to the use of cadmium or zinc and for all practical purposes this prohibits use of this type of process for coating fasteners for the purpose of inhibiting corrosion. Such peen plated parts often are subject to excessive porosity to a prohibitive extent, if applied to fasteners and such that insufficient corrosion inhibiting protection is provided when fasteners coated by this process are utilized in their normal environment.

Fasteners made entirely of aluminum, or other noncorrosive materials have been used in an effort to overcome the problem of excessive corrosion and to some extent this type of fastener may have been successful in meeting some of the problems. However, fastenings of this type have proved lacking in structural properties essential to the proper functioning of the usual fastening installation. These nonferrous fasteners were fabricated from relatively soft material lacking the required strength and rigidity and when hardened became brittle to the point where even in the act of their installation they were subject to fracture. The prior art includes disclosures of the basic concept of extruding a nonferrous coating onto a ferrous metal core. For example Lang et al U.S. Pat. No. 3,399,557 teaches that an aluminum coating can be extruded onto a steel core. This patent however, utilized aluminum billets in the process which precluded continuous extruding which is necessary if a clad product is to be obtained of any length desired. Further, Lange et al relied upon supplemental heating of the cladding metal in order to attain the required temperatures. De Buigne U.S. Pat. No. 3,095,973 and Kaplin U.S. Pat. No. 3,875,782 also teach the extrusion of nonferrous metals around a ferrous metal core but these disclosures also are restricted to processes which are not continuous and this is not inadvertent on the part of the several inventors. Their processes cannot be made to be continuous with the ability to feed billets of infinite length and as a result of this limitation, the processes have found limited acceptability commercially. While Lang et al extrudes the cladding metal around the core metal cross-axially to the direction in which the discrete billets are fed, both De Buigne and Kaplin extrude the cladding metal around the core metal coaxially in the same direction as the feeding of the billets.

Federman U.S. Pat. No. 3,561,399 and Reynolds U.S. Pat. No. 2,543,936 may disclose continuous processes of cladding but in Federman the metal again is fed coaxially and in both of these disclosures the cladding metal enters the cladding die in a molten state. Therefore, in the finished product, the coating comprises a cast structure and as is well known cast structures have physical properties inferior to the properties of wrought structures such as obtained by extrusion.

King U.S. Pat. No. 3,620,119 discloses a coating arrangement for but a portion of an electroplated fastener and is specifically restricted to a particular manner of extruding a "slug" of plastic, or aluminum, onto the fastener.

Harkenrider British Pat. No. 805,617 discloses what he describes as a continuous process of extruding, but he utilizes billets as his feedstock and more importantly the disclosure relates to a linear extrusion method and relies on a heated cylinder and die in plasticizing the billets.

Heretofore, much cladding work has been accomplished by a method of co-extrusion where the core material to be clad was enclosed in the cladding material and the composite structure then extruded through a die orifice. Copper clad aluminum wire was made by this method wherein an aluminum rod was inserted into a copper tube and then this assembly was extruded. In such co-extrusion processes both the core and the cladding material were reduced in cross sectional area during the extrusion operation. Such methods may be acceptable where softer metals such as copper and aluminum may be involved. However, when it becomes necessary to apply a coating such as aluminum, or copper, around a high strength steel core, co-extrusion is difficult, if not impossible, because of the high extrusion pressure which would be required to reduce such a steel core in cross section. Significantly less extrusion pressure would be required if the steel core could be passed through the extrusion die without its cross-sectional area being reduced but reduce only the cross-sectional area of the cladding material. This invention successfully accomplishes that purpose.

SUMMARY OF THE INVENTION

This invention relates generally to a continuous method of cladding a member for use in metal work and to the provision of a protective coating therefor. The process can be utilized to provide an electrical conductor where an aluminum cladding would carry the electrical current and a steel core would afford the strength to support the tensile load. Basically this concept provides a method and apparatus for continuously producing such member in the form of a corrosion resistant nonferrous wire of infinite length having a metal core for strength and particularly tensile strength. The nonferrous layer on the wire is of ample thickness to prevent rupture thereof in normal usage and such that forming operations may be performed thereon, as in bending, or the formation of a head portion and point, on respective end portions of a wire section, or the forming of threads, as for a screw or a bolt, all without exposing the metal core to the atmosphere, or to contact with other materials with which it may be joined, such as work pieces normally encountered in its usual environment.

The invention contemplates a method and apparatus for producing a corrosion resistant nonferrous clad metal wire of any length by a high pressure continuous extrusion system wherein heat generated by the extrusion process comprises a source of heat utilized in coating the metal core with the non-ferrous corrosion preventing outer layer. This system utilizes a cross-axis die in the high pressure extrusion process wherein the nonferrous metal being extruded, such as aluminum, or the like, is forced into the cross-axis die under great pressure which generates sufficient heat to render the aluminum plastic. This heat as used with this system, may be supplemented by pre-heating the metal core and/or the feedstock, if desired and while the aluminum is in the plastic state the metal core passes through the nonferrous metal at its point of plasticity to be clad with the plastic metal and the clad core emerges from the die through a passage of a size to control the thickness and uniformity of the non-corrodible outer layer surrounding the inner metal core, where the core enters the die passage that regulates and controls the thickness and uniformity of the coating. The nonferrous metal is further extruded around and onto the core to effect a complete bond therewith and provide a force which draws the core through the die. This occurs because this passage is larger than the orifice where the core enters the die and with the increased clearances around the core in the outlet passage, the nonferrous metal will extrude more readily and preferentially through this passage around the core. This action causes additional core to be drawn into the entrance orifice and this acts further to prevent the nonferrous metal from extruding through the entrance orifice. The process becomes self-feeding so that the core will feed into the die as long as the extrusion operation is continued.

OBJECT OF THE INVENTION

It is the primary purpose of the invention to provide a metal clad wire wherein a metal core, or a nonmetallic core, affords strength and rigidity and a nonferrous coating prevents corrosion.

The principal object of the invention is the production of a nonferrous metal clad core formed continuously by passing the core through the nonferrous metal while the latter is in a plastic state.

An important object of the invention is to produce a wire by forcing nonferrous metal into a die under great pressure whereby the nonferrous metal is rendered plastic and then passing the core into the die and through the plastic portion of the nonferrous metal with the extrusion process affording a self-feeding continuous operation.

A further object of the invention is the production of a corrosion inhibiting wire by extruding a nonferrous metal under great pressure through one side of a cross-axis die into a central cavity, in a plastic state and passing a metal wire into another side of the die at substantially a right angle to the direction of entry of the nonferrous metal, through the plastic nonferrous metal and emerging into an exit passage at the other side of the die where the nonferrous metal is further extruded around and onto the wire which is thus coated with the corrosion inhibiting coating and wherein the extruding action draws the wire through the die continuously while the extrusion process is continued.

Another object of the invention is to produce a corrosion inhibited clad wire by passing a metal wire entirely through a cross-axis die into which a non-ferrous metal is extruded to provide a plastic portion through which the metal wire passes and wherein the entering opening into one side of the die for the metal wire is of a diameter affording minimum clearance for the wire and the exit opening from the die through the other side of the die for the clad wire, is of a diameter to provide and control the desired thickness of the cladding material surrounding the core and by a further extruding action of the plastic metal through the exit opening through the other side of the die, provides a self-feeding action which draws the wire through the die without reducing the diameter of the wire core.

DESCRIPTION OF THE DRAWINGS

The foregoing and other and more specific objects of the invention are attained by the structure and arrangement illustrated in the accompanying drawings wherein.

DESCRIPTION OF PREFERRED EMBODIMENT

Figure 1:
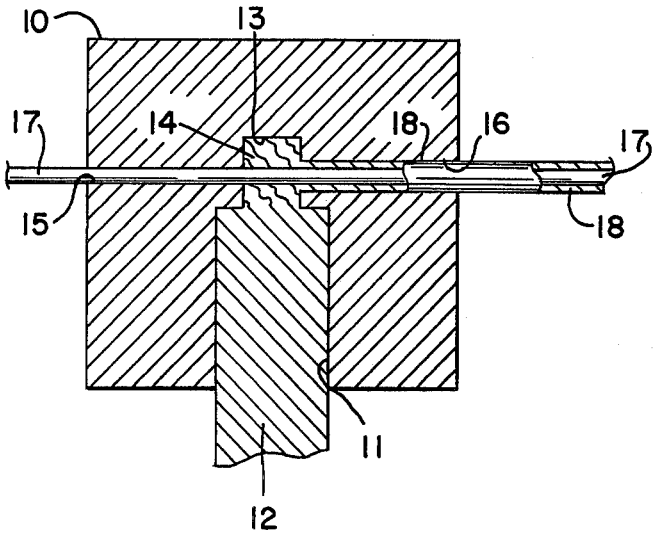
FIG. 1 is a general view of a cross-axis die apparatus illustrating an opening in one side of the die for extruding a nonferrous metal into a central cavity in a plastic state and an opening through the die for entry of a metal wire at one side which is drawn through the plastic metal by a further extruding action of the plastic metal around the wire into an exit opening from which the wire emerges at the opposite side of the die fully coated.
Figure 7:
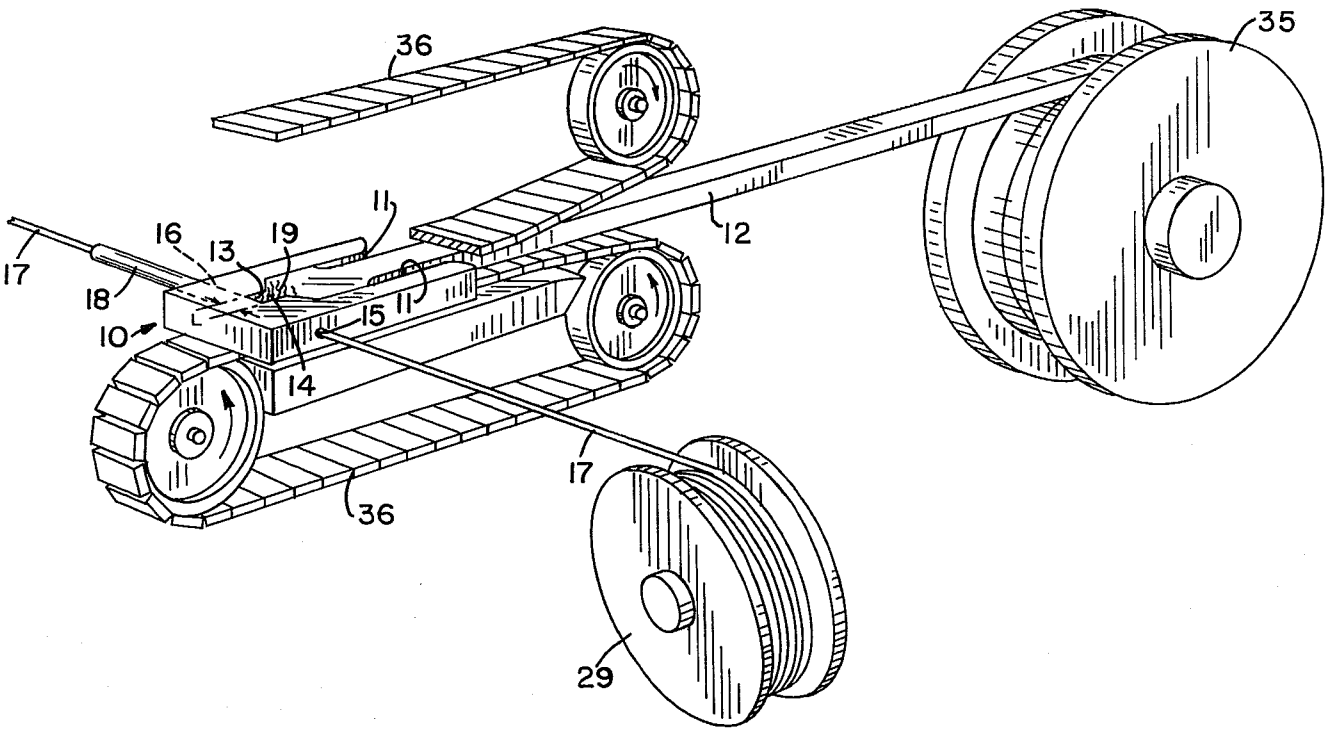
FIG. 7 is a generally schematic illustration of an arrangement including a driving means for continuously feeding a nonferrous metal rod from a reel, or the like, into a cross-axis extruding die.

In the drawings, looking at FIGS. 1 and 7, a cross-axis die 10 is illustrated having an opening 11 into which metal rod 12 is entered and extruded through an extruding opening 19 under great pressure into a central cavity 13 where the rod reaches a plastic state as indicated at 14. The rod 12 is formed from a nonferrous metal, such as aluminum and when it is forced into the cavity 13 during extrusion through the relatively smaller opening 19 it is the high pressure of this operation that generates sufficient heat, resulting in the metal reaching a plastic state as it enters and fills the cavity 13. An entering opening 15 is provided in a side of the die 10 and which leads into the central cavity 13. An exit opening, or passage 16 leads into the central cavity 13 at the other side of the cavity and emerges through the opposite side of the die.

The openings 15 and 16 are axially aligned across the die and provide a continuous passage through the die generally at right angles to the direction of the opening 11 for the metal rod 12. By "plastic state" is meant that property of the nonferrous metal under increased temperature whereby the particles thereof have the ability to move easily and change their relative positions without departing from solid form so that under pressure the heated metal is capable of plastic flow.

A continuous length of a metal wire 17 is fed from a reel 29 or the like into the die opening 15 and passes through the plastic metal 14 in the cavity 13. The plastic metal joins with the wire and the wire 17 and this outer layer of plastic metal feeds through the exit opening, or passage 16, where the plastic metal is further extruded around the wire which forces the coating layer into intimate engagement with the wire core to provide a cladding 18 and provide a strong bond of the clad coating to the wire. The entering opening 15 is dimensioned to the diameter of the wire 17, with minimum clearance, whereby the wire is closely guided as it passes into the cavity 13 and through the plastic metal 14. The exit opening 16 is utilized to control the thickness and the uniformity of the clad coating 18 on the wire core and accordingly is dimensioned to the combined diameter of the wire core 17 and the surrounding outer layer 18. The diameter of the opening 16 is dimensioned to provide the desired predetermined thickness of non-corrodible metal to be deposited entirely around the core 17 and the resulting clad wire is extruded to an exact diameter in accordance with that desired, for example, in making fasteners of the type to be manufactured for a particular production run. The heat generated by extruding the nonferrous coating through the opening 16 maintains the state of the metal 14 for plastic flow so that the metal forms around the wire core 17 and bonds with itself, enclosing the core and bonds effectively to the core, as well. In fact, where the temperature of the plastic metal in the cavity 13 may reach approximately 500° F. or 550° F., the further extrusion of such metal through the passage 16 on the core 17, may cause the plastic metal to reach a temperature as high as approximately 700° F. or 750° F.

The exit passage 16 and the additional extruding operation at this stage afford another benefit which is realized in this extrusion process. It will be seen that the nonferrous metal 12 and the metal wire core 17 intersect in the cavity 13 of the die and the plastic nonferrous metal in effect, splits as it flows around the metal wire and rejoins on what might be referred to as the back side of the wire at this point. A seam would be formed where the plastic metal rejoins and enters the passage 16 but this passage functions additionally more or less like a welding chamber to eliminate this seam by forcing the abutting surfaces of the split plastic metal along the seam to weld together. This welding occurs because of the increased temperature of the nonferrous metal induced by the further extrusion through passage 16, where the pressure generated during this substantial reduction in the cross sectional area of the nonferrous metal extruded through the passage, results in the higher temperature and consequent welding of the plastic metal across the seam, which is thus eliminated.

An essential element in this invention resides in the utilization of a cross-axis die of the types indicated in FIGS. 1 and 7, where it will be seen that the nonferrous metal rod 12 enters the die 10 through an opening 15 in another side of the die. The wire core 17, encased in the coating of nonferrous metal, passes through the die and exits at the opposite side in axial alignment with the one side, so that the passage of the wire 17 through the die is at right angles to the entrance direction of the rod 12. The inlet opening 15 has an inside diameter dimensioned to the core wire 17 and only slightly larger than the diameter of the wire. However, at the opposite side of the die beyond the interior cavity 13, the exit opening 16, where the nonferrous metal is extruded around the wire, is somewhat larger than the diameter of the wire as determined by the thickness of the cladding material desired to be placed on the wire. The clearance between the core wire 17 and the orifice represented by the passage 16, is equal to the thickness desired in the coating. Because the clearance around the wire core 17, in the passage 16, is greater than that around the wire in the inlet opening 15, the plastic nonferrous metal 14, in the cavity 13, will extrude most readily and preferentially through the passage 16 around the wire core. This extrusion of the plastic metal through the passage 16, of course, draws the core wire through with it, as referred to hereinbefore and this action induces a self-feeding continuing operation to pull the wire 17 from the reel 29 into the inlet opening 15 and thus provide a continuous process. This operation is facilitated by the arrangement of the cross-axis die 10. The path through the die defined by the openings 15 and 16, through the cavity 13, of course, is at right angles to the direction of feeding the rod 12 into the central cavity of the die. But it is important to note that the openings 15 and 16 are axially aligned so that the core wire 17 may be fed more readily through the die and is more easily drawn into and through the die by the force of the further extrusion of the plastic metal 14 through the passage 16 around the wire.

The nonferrous metal rod 12 is also fed into the die 10 from a reel 35, or the like, and so long as the extrusion operation continues the wire 17 will flow into the die and the aluminum feedstock rod 12 will feed into the die opening 11 and thus provide a continuously operating extrusion process, whereby a coated wire of infinite length may be obtained. The opening 11 into the die is of such depth that a new feedstock rod 12 may be inserted directly behind the end of the preceding rod as it is consumed and of course, a new feed wire 17 may be welded to the wire going through the die at some point before the first wire end reaches the die and then follow into the opening 15 in the die as the preceding wire is fed through the die. In this manner the extrusion and wire coating process can continue uninterruptedly as new feedstock supplies are added. The apparatus for performing this process may be similar to that disclosed in prior U.S. Pat. No. 3,922,898, issued to one of the present inventors and which disclosure is hereby incorporated herein by this reference. As shown in FIG. 7, the flexible bands, or endless belts 36, grip the feedstock 12 to advance the feedstock into the die 10 and maintain the continuous operation of the extrusion process as the core wire 17 is fed into the die, as described hereinabove. The belts 36 are of a width to bridge the cavity 13 in the die and overlap the portions of the die 10 at opposite sides of the cavity so that the feedstock 12 is confined and driven at both top and bottom surfaces thereof.

The clad wire can be produced to any specified diameter with the wire core and outer cladding layer in proper proportions so that subsequent drawing operations to provide clad wire of smaller diameter will produce wire having a desired ratio of metal core to nonferrous metal cladding to provide the non-corrodible coating required.

A tensile load is imparted to the core wire 17 within the die 11 as a result of the shearing action of the nonferrous metal 14 in a plastic state as it extrudes around the wire in the central cavity 13. This shearing action of the coating material occurs because the extruded plastic metal travels faster than the wire 17. The shearing action occurs in the area of the cavity 13 across the distance indicated by the dimension "L" as indicated in FIG. 7. As hereinbefore referred to, the core wire 17 passes through the die during the extrusion operation without being reduced in its cross sectional area. To achieve this means that the tensile load developed over the surface area of the wire 17 across the distance represented by the dimension "L" must be maintained less than the resistance to plastic deformation of the wire. This tensile load can be expressed by the equation $$\text{Tensile Load} = \pi DLK_{CLAD}$$

Where D is the diameter of the core wire and $K_{CLAD}$ is the shear strength of the cladding feedstock 14. The resistance to plastic deformation of the core wire 17 can be expressed by the equation $$\text{Deformation Resistance} = (\pi/4)D^2 Y_{CORE}$$

Where $Y_{CORE}$ is the yield strength of the wire 17. Since Tensile Load > Deformation Resistance then $$\pi DLK_{CLAD} < \frac{\pi}{4} D^2 Y_{CORE} \text{ and } L < \frac{D}{4} \times \frac{Y_{CORE}}{K_{CLAD}}$$

As an example, we assume that an aluminum coating is to be extruded around a steel core wire. Assuming that D=0.125", $Y_{CORE}$=120,000 PSI and $K_{CLAD}$=15,000 PSI. Then $$L < \frac{.125}{4} \times \frac{120{,}000\text{PSI}}{15{,}000\text{PSI}} \text{ or } L < .250''.$$

This means that where the design of the die is such that the dimension "L" is less than 0.250", the core wire 17 will pass through the die 10 and the extrusion process without being reduced in cross sectional area. This method can be utilized in a system where the nonferrous metal feedstock rod 12 is continuously forced into the extrusion die 10 of such design that the core wire 17 can be passed through the die at right angles to the direction of introducing the rod 12. An advantage of this is that the die of this type is more readily accessible for introduction of the wire 17 and as compared to conventional extrusion presses the extrusion ratio for the cladding feedstock 14 is much lower.

The relative dimensions of the non-corrodible coating 18 with respect to the central metal core 17 can be varied in accordance with conditions to be met in any use to which the final product is to be put. As an example of one field of use to which the product of this invention might be put, the invention is disclosed for application in the manufacture of fasteners of various types. In this type of application, if the size of the core wire 17 is relatively large in relation to the coating layer 18, the strength and rigidity of a fastener made from this will be greater, but the corrosion resistance will be reduced. On the contrary, where the outer coating layer 18 is of relatively heavier thickness in relation to the diameter of the core wire 17, the corrosion resistance will be increased, but the strength of the fastener will be reduced. The diameter of the core wire 17 can be varied, of course, according to the predetermined strength of the fastener required for the intended application and of course, the corrosion resistance desired can be obtained to any degree necessary by varying the thickness of the outer coating layer 18. An optimum condition may be obtained where the corrosion resisting coating 18 is maintained at a minimum thickness in the range of 0.005" to 0.010" for fasteners where it is not necessary for the fastener to be threaded. If the fastener is intended to be threaded, or if any other deformation of the fastener shank is to be resorted to, then the outer coating layer 18 should be maintained at a thickness of about 0.020".

Figure 2:
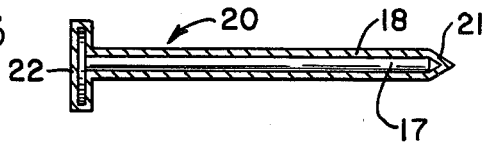
FIG. 2 is a view similar to FIG. 1, showing a nail made from this coated wire where the surface of the coating is provided with deformations which afford greater holding power when the nail is driven.
Figure 3:
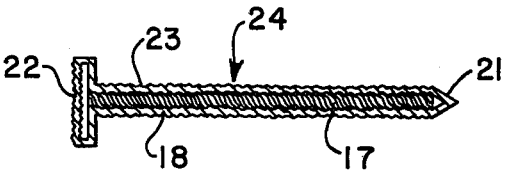
FIG. 3 is a view similar FIG. 1, showing a similarly coated nail where the surface of the coating is provided with deformations which afford greater holding power when the nail is driven.

This inventive concept can be utilized in the manufacture of various types of fasteners including corrosion resistant nails, screws, bolts, and staples, or the like and the relative proportions of the metal core 17 and the nonferrous outer coating layer 18 will be varied according to the particular type of fastener for which it is used. The invention is disclosed in FIGS. 2 and 3 as applied to two types of nails incorporating the anticorrosive properties afforded by the use of the present coated wire core. In FIG. 2, the nail 20 is shown as of the ordinary or usual type having a pointed driving end 21 and a head 22 for pounding the nail into its driven position. FIG. 3 illustrates a coated nail similar to that shown in FIG. 2, but wherein the corrosion resistant coating 18 is provided with surface deformations 23 on the shank areas of the nail and on the point 21 and head 22 as well. These surface indentations provide greater holding properties for the nail when driven into the workpieces it is used to secure.

The final forming of the fasteners from this coated wire as in the formation of the points 21 and the heads 22 of the nails 20 and 24 of FIGS. 2 and 3 respectively, can be done in accordance with known processes that will assure a finished product where the metal core 17 will not be exposed by breaking the outer coating layer 18. One example of the techniques required for this purpose is taught by U.S. Pat. No. 2,718,647, but other methods for performing these operations may be known to those experienced in this art.

Figure 4:
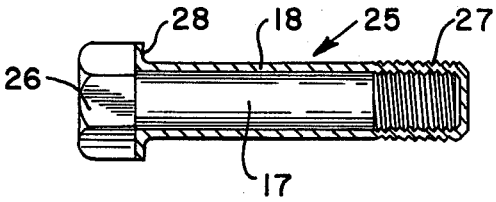
FIG. 4 is a longitudinal sectional view of a bolt manufactured and formed in accordance with the invention.

As shown in FIG. 4, the coated wire of this invention is converted into a bolt 25, having a head 26 and a threaded end 27. The outer cladding layer 18 includes a flange portion 28, underlying the bolt head 26, so that when applied to connect workpieces, no part of the bolt will come in contact with the workpiece. The head 26 of the bolt is formed by upsetting the core 17 in a suitable machine to form the hexagonal shape required for driving the bolt, while the thickness of the corrosion resisting cladding layer 18 is maintained of such thickness as to provide the anti-corroding properties and to enable the threading 27 without destroying such properties.

Figure 5:
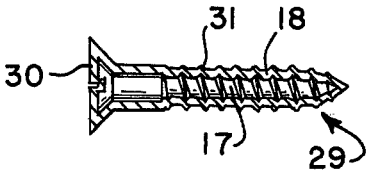
FIG. 5 is a sectional view similar to FIG. 4, showing a typical screw manufactured and formed in accordance with the teachings of this invention.

FIG. 5 illustrates the coated wire of this invention as applied to a typical screw 29 having a slotted head 30 and a threaded shank 31. Here again the outer coating layer 18 is maintained at a relative thickness in relation to the core 17 such as will enable the forming of the threads 31 without exposing the core metal 17 and providing a finished screw having the required strength properties.

Figure 6:
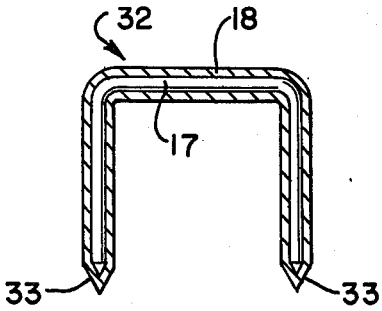
FIG. 6 is a sectional view through a staple formed from coated wire manufactured according to this invention.

The coated wire of this invention is utilized in the manufacture of staples as shown in FIG. 6. Here the relative proportions of the coating layer 18 and the wire core 17 are such that the bending of the wire to form the staple 32 will not fracture the coating and expose the core. The points 33 of course, can be formed according to known processes.

In the method of this invention the core metal 17 may be formed of steel, but other materials having the required structural strength and rigidity, as well as other properties, can be utilized if preferred. The outer coating layer 18 may be made of aluminum, copper, or other materials that are resistant to corrosion inducing atmospheres and to galvanic action. It is to be understood that the invention may be utilized to clad non-ferrous metal cores as well as ferrous metal cores. Reference has been made to metal cores but the invention contemplates also that non-metallic cores might be utilized where desirable. Examples of non-metallic core materials may includes graphite fibers, ceramic fibers, glass fibers, kevlar and aramid fibers, or the like.

It is important to note that this invention provides a continuous extrusion process which extrudes a coating onto a core wire without reducing the cross-sectional area of the wire in a die where feedstock is fed into one side of the die and the wire core is fed through the die at right angles to the direction of the feedstock, which is extruded into a central die cavity, about the wire and then further extruded around the wire, through an exit passage in the die, which further extrusion draws the wire into the die, to provide a self-feeding continuous action.

What is claimed is:

1. The method of forming a metal clad wire for the manufacture of fasteners by passing a ferrous metal wire through a plasticized portion of a nonferrous metal, comprising continuously extruding a nonferrous metal into a die under pressure to form said plasticized portion, passing a ferrous metal wire through said die at substantially a right angle to the direction of the passage of said nonferrous metal and through said plasticized portion, and said portion directly engaging and splitting around the said wire to provide a wrought aluminum structure enclosing the wire, the extrusion pressure comprising the source of heat generated to render the cladding material plasticized in said die.

2. A continuous process of extruding a cladding material onto a core element without reducing the cross sectional area of the core comprising feeding a feedstock into one side of an extrusion die, feeding a continuous core through the die at right angles to the direction of feeding the feedstock to intersect directly with the feedstock in the die which directly engages the core and splits around the core thus first extruding the feedstock about the core in the interior of the die, and further extruding the feedstock around the core subsequent to said first extruding, heat produced in the feedstock by said first extruding rendering the feedstock in a plastic state in said die to enable feedstock to be added as the feedstock is consumed and thus maintain said continuous process, and the heat of said further extruding facilitating the further extruding operation.

3. A method of forming metal clad wire in a crosshead die comprising extruding a solid nonferrous metal through one side of the die into a central cavity with sufficient pressure to convert said metal from a solid to a plastic state, passing a ferrous metal wire into another side of said die at an angle to the extrusion angle of the nonferrous metal, said wire passing through the plastic nonferrous metal in said central cavity, said plastic metal directly engaging and splitting around said wire to provide a wrought aluminum structure enclosing the wire, said wire and structure emerging through the opposite side of said die, said die at the side where the ferrous metal wire passes into the die having an opening of a diameter affording minimum clearance for the wire, and said die at the opposite side having a larger opening of a diameter to extrude the wire and coating through this opposite opening and form the coating on the wire, the heat of extrusion through the last mamed opening enabling the nonferrous metal to form a uniform coating thickness enclosing said ferrous metal wire according to the diameter of the last named opening, the extrusion pressure on said nonferrous metal providing the source of heat to plasticize the metal.

4. A method of forming a clad wire in a die having a cavity, continuously extruding a nonferrous metal into said cavity of the die under extrusion pressure to generate heat such as to render the nonferrous metal in a plastic state in said cavity which enables feedstock to be added as the feedstock is consumed and thus maintain continuous extrusion, passing a continuous ferrous metal wire into an entering orifice of said die which intersects with the plastic portion of said nonferrous metal in the cavity generally at a right angle to the direction of extruding the nonferrous metal into the die which directly engages the wire and splits around the wire and forms a nonferrous coating layer around the wire, whereby said clad coating layer provides a wrought aluminum structure enclosing the wire, and passing said coated ferrous metal wire through an exit opening in the die of larger diameter than said entering orifice to further extrude and form the nonferrous coating layer around and bonded on the ferrous metal wire to provide a predetermined coating thickness of uniform diameter conforming with said larger diameter, said extrusion pressure being the source of rendering the nonferrous metal in said cavity in a state of plastic flow and the heat of the further extruding facilitating forming and bonding the coating on the wire.

5. A method of forming a clad wire in a die having a cavity, continuously extruding a nonferrous metal into said cavity of the die under extrusion pressure to generate the sole source of heat such as to render the nonferrous metal in a plastic state in said cavity, passing a ferrous metal wire into an entering orifice of said die and through the plastic portion of said nonferrous metal generally at a right angle to the direction of extruding the nonferrous metal into the die which directly engages the wire and splits around the wire and forms a nonferrous coating layer around the wire to provide a wrought aluminum structure enclosing the wire, and passing said coated ferrous metal wire through an exit opening in the die of larger diameter than said entering orifice to further extrude and bond the nonferrous coating layer around and on the ferrous metal wire to provide a predetermined coating thickness of uniform diameter conforming with said larger diameter, said extrusion pressure being the only source of rendering the nonferrous metal in a state of plastic flow and the heat of the further extruding facilitating such further extruding.

6. A method of forming a metal clad wire as set forth in claim 5 wherein said nonferrous metal is extruded into said cavity from one side of said die, said ferrous metal wire is passed into said entering orifice at another side of the die, and said coated wire passes through said exit opening in axial alignment with the wire at the entering opening and exits through a third side of the die at substantially a right angle to said one side.

7. A method of forming a metal clad wire as set forth in claim 6 and locating said cavity centrally in said die coincident with the axis of the ferrous metal wire and the entrance of the nonferrous metal.

8. A method of forming a metal clad wire as set forth in claim 6 and providing said entering orifice with a diameter providing minimum clearance for the uncoated wire, and further providing an exit of a diameter to force the plastic nonferrous metal into bonded engagement with said wire and defining the total diameter of the coated wire, and providing said die with an entrance to said cavity for said nonferrous metal of greater diameter than said orifice or said opening.

9. A continuous process of extruding as set forth in claim 2 wherein said further extruding draws said core element through said die.

10. A continuous process of extruding as set forth in claim 2 wherein said die includes a central cavity, an opening for said feedstock through one side of the die having a restricted entrance to said cavity, an entering opening in another side of the die for said core, and an exit opening in a third side of the die forming a passage for the emerging clad core, said entering opening being in axial alignment with said exit opening.

11. A continuous process of extruding as set forth in claim 10 wherein said feedstock is first extruded through said restricted entrance into said cavity about the core, and further extruding the feedstock through said passage around the core, said further extruding drawing the core through the die to thereby provide a self-feeding extrusion operation.

12. A continuous process of extruding as set forth in claim 10 wherein the distance across said cavity in relation to the diameter of said core is such that the core will pass through the die without any reduction in its cross-sectional area.

13. A continuous process of extruding as set forth in claim 10 wherein said entering opening is closely dimensioned to the diameter of said core and said passage being of a diameter larger than the entering opening to define the thickness of the cladding material on the core.

14. A method of forming metal clad wire as in claim 1 wherein said nonferrous metal is aluminum and said metal wire is steel.

* * * * *